US005674128A

United States Patent [19]

Holch et al.

[11] Patent Number: 5,674,128

[45] Date of Patent: Oct. 7, 1997

[54] CASHLESS COMPUTERIZED VIDEO GAME SYSTEM AND METHOD

[75] Inventors: Niels C. Holch, Arlington, Va.; Frank J. Riolo, Rome, N.Y.

[73] Assignee: Oneida Indian Nation, Vernon, N.Y.

[21] Appl. No.: 719,651

[22] Filed: Sep. 25, 1996

Related U.S. Application Data

[63] Continuation of Ser. No. 391,509, Feb. 21, 1995, abandoned.

[51] Int. Cl.[6] ..... A63F 3/06

[52] U.S. Cl. ..... 463/42; 463/18; 463/19; 463/22

[58] Field of Search ..... 463/10, 16, 17, 463/18, 19, 22, 42

[56] References Cited

U.S. PATENT DOCUMENTS

| | | | |
|---|---|---|---|
| 4,240,635 | 12/1980 | Brown . | |
| 4,283,709 | 8/1981 | Lucero et al. . | |
| 4,335,809 | 6/1982 | Wain . | |
| 4,339,798 | 7/1982 | Hedges et al. . | |
| 4,467,424 | 8/1984 | Hedges et al. . | |
| 4,494,197 | 1/1985 | Troy et al. . | |
| 4,575,622 | 3/1986 | Pellegrini . | |
| 4,636,951 | 1/1987 | Harlick . | |
| 4,648,600 | 3/1987 | Olliges . | |
| 4,669,730 | 6/1987 | Small . | |
| 4,760,527 | 7/1988 | Sidley . | |
| 4,815,741 | 3/1989 | Small . | |
| 4,856,787 | 8/1989 | Itkis . | |
| 4,880,237 | 11/1989 | Kishishita . | |
| 4,882,473 | 11/1989 | Bergeron et al. . | |
| 4,926,327 | 5/1990 | Sidley . | |
| 5,038,022 | 8/1991 | Lucero . | |
| 5,119,295 | 6/1992 | Kapur . | |
| 5,159,549 | 10/1992 | Hallman, Jr. et al. . | |
| 5,179,517 | 1/1993 | Sarbin et al. . | |
| 5,197,094 | 3/1993 | Tillery et al. . | |
| 5,223,698 | 6/1993 | Kapur . | |
| 5,265,874 | 11/1993 | Dickinson et al. . | |
| 5,287,269 | 2/1994 | Dorrough et al. . | |
| 5,297,802 | 3/1994 | Pocock et al. | 273/269 |
| 5,324,035 | 6/1994 | Morris et al. . | |
| 5,326,104 | 7/1994 | Pease et al. . | |
| 5,332,076 | 7/1994 | Ziegert . | |
| 5,371,345 | 12/1994 | LeStrange et al. . | |

FOREIGN PATENT DOCUMENTS

| | | | |
|---|---|---|---|
| 8906998 | 8/1989 | WIPO | 273/269 |

OTHER PUBLICATIONS

POT-O-GOLD, "19" Touchscreen Multi-Game Terminal Superpick Lotto© Play Description.

POT-O-GOLD, "19" Touchscreen Multi-Game Terminal Touch 6 Lotto© Play Description .

POT-O-GOLD, "19" Touchscreen Multi-Game Terminal Touch 6 Lotto© Technical Description.

POT-O-GOLD, "19" Touchscreen Multi-Game Terminal Supergold Bingo© Play Description.

*Primary Examiner*—Jessica Harrison
*Assistant Examiner*—James Schaaf
*Attorney, Agent, or Firm*—Finnegan, Henderson, Farabow, Garrett and Dunner, L.L.P.

[57] ABSTRACT

A coinless video game system includes a plurality of electronic video game terminals, a game server corresponding to each player terminal, and a central control network for administering and controlling games and player accounts. A player initially establishes a player account in the central control network and receives a player I.D. card bearing the player's account number and other relevant information. Players use these I.D. cards to establish sessions at a player terminal. The server provides a random number to each player terminal at predefined intervals to determine wins and loses for each game selected by a player. Waged amounts are then debited or credited to a player's account in the central control network. Players may redeem any account balance from a cashier associated with the central control network.

10 Claims, 5 Drawing Sheets

CASHLESS COMPUTERIZED VIDEO GAME SYSTEM AND METHOD

This application is a continuation of application Ser. No. 08/391,509, filed Feb. 21, 1995, now abandoned.

BACKGROUND OF THE INVENTION

This invention relates generally to the field of computer-controlled games, and more particularly to the field of automated control of banks of gaming devices.

Over the years, people have used several different types of coin-operated gaming devices. The most ubiquitous is the conventional slot machine. To operate a slot machine, a player inserts one or more coins, bills, or tokens (referred to generically as coins) into a coin receptacle and then takes some action, such as pulling a handle or pushing a button. In response, the machine generates some output determined solely by chance. If that output fits into one of several narrowly-defined categories, then the player is rewarded with an amount of money reflecting the particular output and the odds of obtaining it.

Despite their popularity, traditional slot machines have several features which some find undesirable. For example, because they are mechanical devices, they often jam and require frequent repair. Also, they require coins, which forces establishments having the slot machines to provide a great deal of security and accounting checks to avoid theft or corruption. Players are also susceptible to the loss or theft of the coins.

In addition, most slot machines are designed only to play a single game, such as a lottery game, a video poker game, or a keno-type game. Players wishing to play a specific game must often go in search of a machine to play that game.

Also, many states prohibit slot machines, which are defined as devices that both receive and dispense items of value, such as coins, and which each have their own set of odds. Some of those states, however, allow other types of games, similar to the instant keno games.

The computer revolution, however, has greatly aided the gaming industry. For example, in one keno game, a single computer can show the same keno game on several displays so many players can participate. This type of system also avoids the need for players to continually insert coins into a machine because the computer monitors their accounts.

Such a system, however, still has somewhat limited capabilities, not the least of which is the system only allows players to choose one type of game. Also, the PC-based controller has limited processing and accounting capabilities.

Another system, offered by U.S. Games, Inc., a manufacturer of slot machines, contains a game server to control several player terminals. Each player terminal allows a player to choose from several games. This system, however, does not manage the players' accounts, nor does it keep track of other information deemed important by gaming establishments.

SUMMARY OF THE INVENTION

Accordingly, it is an object of this invention, to provide and improved gaming device that controls a number of video terminals and keeps track of the accounts of users of that terminal.

Another object of this device is to allow players to select from multiple games at a player terminal.

Yet another object of this invention is to provide a gaming device that also provides additional information about the players' use of the terminals.

A further object of the invention is to provide a game that does not contravene conventional state gaming laws.

Still another object of the invention is to provide a cashless interactive game environment.

Additional features and advantages of the invention will be set forth in the description which follows, and in part will be apparent from the description, or may be learned by practice of the invention. The objectives and other advantages of the invention will be realized and attained by means of the instrumentalities and combinations particularly pointed out in the written description and appended claims hereof as well as the appended drawings.

To achieve these and other advantages and in accordance with the purposes of the invention, as embodied and broadly described, the invention defines a system for operating several electronic games for a plurality of players comprising a plurality of player terminals coupled together. Each terminal includes means for receiving player identification information from a participating player, means for receiving game selection information from the participating player, means for executing a plurality of different electronic games, and a video display for displaying a selected one of the games to the participating player. The system also includes a game server connected to each of the plurality of player terminals. The game server includes means for generating a random number and sending the random number to each of the player terminals connected to it. Also, the system includes a central controller connected to each of the player terminals. The central controller includes means for storing player account information for each of the players, and means for adjusting the account information of the players according to the results of the games in which each of the players participates.

In accordance with the purposes of the invention, as embodied and broadly described, the invention also includes a method of operating electronic games in a system including a central controller, a game server, and a plurality of player terminals. The method includes the steps of establishing a player account file at the central controller; receiving, at a selected player terminal, player identification information input by a participating player; displaying a selection of electronic games on a video display of the selected player terminal; receiving, at the selected player terminal, information for a selected one of the electronic games; executing, at the player terminal, the selected electronic game; generating, at the game server, a random number, determining a result of the selected electronic game based on the random number; and updating the selected player's account file according to data from the selected player terminal.

Both the foregoing general description and the following detailed description are exemplary and explanatory, and are intended to provide further explanation of the claimed invention.

BRIEF DESCRIPTION OF THE DRAWINGS

The accompanying drawings, which are incorporated in and constitute a part of the specification, illustrate presently preferred implementations of the invention. Together with the general description given above and the detailed description of the preferred embodiments given below, the drawings explain the principles of the invention.

In the drawings.

DETAILED DESCRIPTION OF THE INVENTION

Reference will now be made in detail to the construction and operation of preferred implementations of the present invention illustrated in the accompanying drawings. In those drawings, like elements and operations are designated with the same reference numbers when possible.

The following description of the preferred implementations of the present invention is only exemplary of the invention. The present invention is not limited to these implementations, but may be realized by other implementations.

Figure 1:
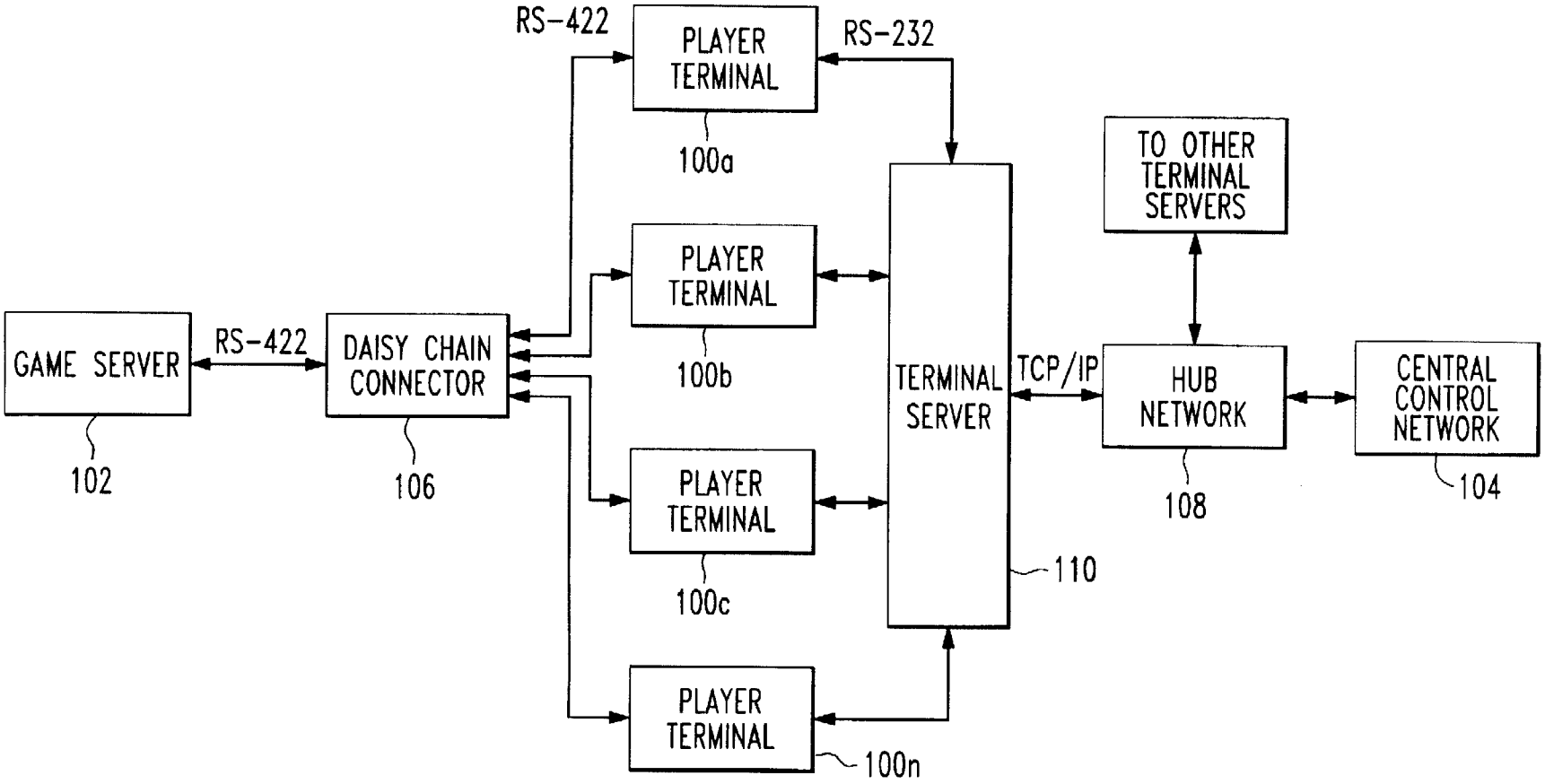
FIG. 1 is a block diagram of a system for operating several electronic games for several players in accordance with one embodiment of the present invention.

FIG. 1 shows a block diagram of a coinless video game system in accordance with a preferred embodiment of the present invention. As shown, the system generally comprises a plurality of player terminals 100*a*–100*n*, a game server 102 connected to each of the player terminals 100*a*–100*n*, and a central control network 104 connected to each player terminal for administering and controlling the player terminals 100 and for maintaining player accounts. Game server 102 preferably connects to the player terminals 100 via a daisy-chain connection 106 and communicates via the RS-422 protocol. The central control network 104 connects to each player terminal 100 via a hub network 108 and a terminal server 110.

In a preferred embodiment, the system also includes a terminal server 110 connected to each player terminal 100 and communicates via the RS-232 protocol. Terminal server 110 converts information from the player terminals 100 to the TCP-IP protocol and communicates the converted messages to the central control network 104 via the hub network 108. Hub network 108 preferably comprises an Ethernet network.

As shown in FIG. 1, a group of player terminals 100*a*–100*n* are serviced by a single game server 102 and a single terminal server 110. In a preferred embodiment, a single game server 102 and single terminal server 110 service up to thirty-two player terminals. Additional groups of player terminals (not shown) are connected to the central control network 104 via the hub network 108. As with the group of player terminals 100*a*–100*n*, any additional groups of player terminals are also preferably serviced by a single game server and are connected to the hub network via a single terminal server. Thus, in accordance with the present invention, a gaming system may comprise hundreds or thousands of player terminals. A single game server and a single terminal server service a group of player terminals, and central control network 104 controls all the groups of player terminals.

Figure 2:
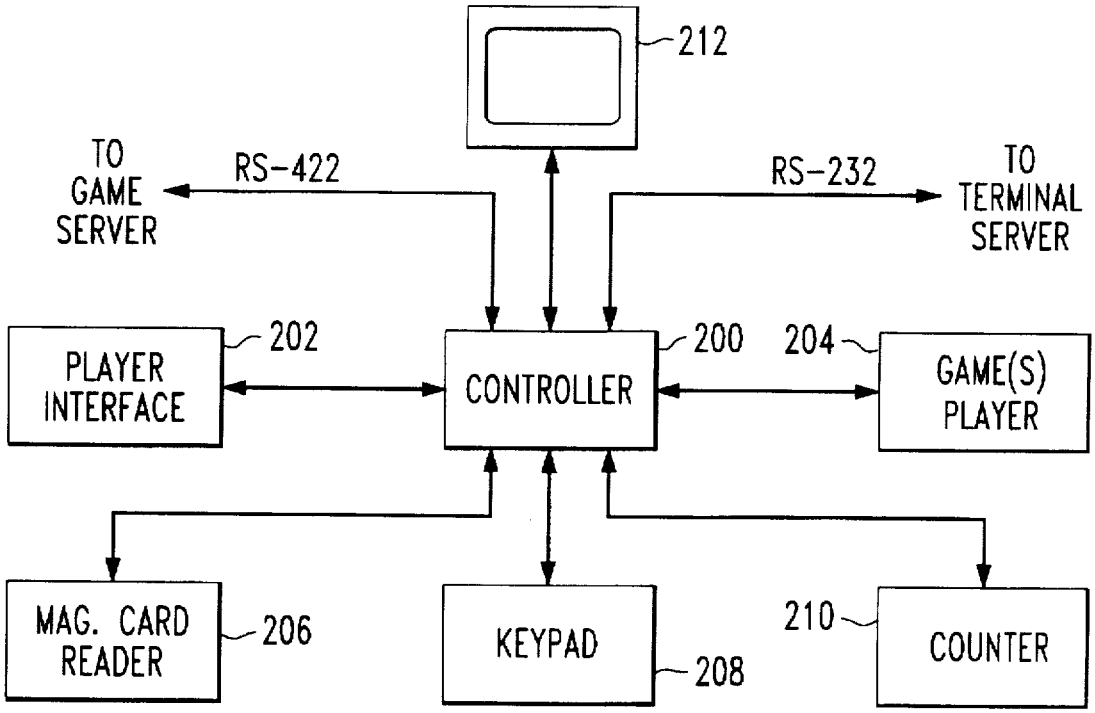
FIG. 2 is a block diagram of a player terminal in accordance with one embodiment of the present invention.

FIG. 2 illustrates a block diagram of a player terminal 100 in accordance with one embodiment of the present invention. Player terminals 100 differ from conventional electronic slot machine-type video game terminals because they do not receive coins and do not pay off winners with coins. Rather, in accordance with a preferred embodiment of the present invention, player terminals 100 accept a magnetic card or key (referred to generically as magnetic card), and communicate with the central control network 104 to debit and credit a player's account based on amounts wagered by the player for each game.

Referring to FIG. 2, player terminal 100 comprises a controller 200, player interface 202, game player 204, magnetic card reader 206, keypad 208, counter 210, and video display 212. Player interface 202 preferably comprises a software application for displaying attract mode graphics to attract a player to the player terminal. Game player 204 preferably comprises software applications running electronic games of chance, such as lotto, keno, bingo, etc. These games are preferably conventional video games of chance except that, as described below, they receive a random number from the external game server 102 and base a win/lose result on that random number and the player's selection. In accordance with the invention, each player terminal 100 plays any one of several games independently of the others. Thus, within a group of player terminals such as player terminals 100*a*–100*n*, several players may be playing keno while others play lotto and still others play video poker. Regardless of the game, the player terminals 100 look to the game server 102 for the random number to determine a result.

Magnetic card reader 206 preferably comprises a conventional magnetic card reader capable of reading a credit card- or smart card-type player identification card. The type of card will dictate the type of card reader.

Keypad 208 preferably comprises a conventional alphanumeric or numeric key entry device. Keypad 208 permits a player to enter a personal identification number ("PIN") to verify the player at the player terminal 100.

Video display 212 preferably comprises a conventional touch screen video monitor for displaying video graphics and receiving player inputs. A touch screen is not necessary, however, since player inputs can be made through keypad 208.

The counter 210 preferably comprises a conventional digital counting device for counting a predetermined interval between game plays. The counter 210 helps synchronize operation.

As described above, electronic games of chance rely on randomly generated numbers to determine wins and losses. Although the video games are preferably played by game player 204 at the player terminals, the random number from which the game player 204 determines wins and loses at each player terminal is generated by the game server 102 servicing those player terminals 100.

Figure 3:
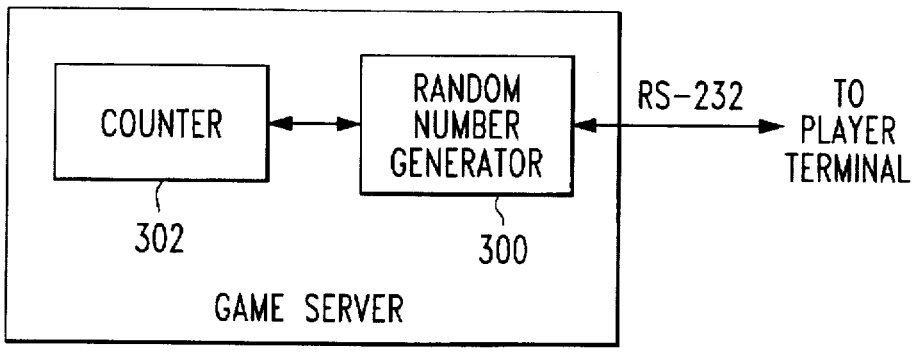
FIG. 3 is a block diagram of a game server in accordance with one embodiment of the present invention.

Thus, as shown in FIG. 3, game server 102 preferably comprises a random number generator 300 and a counter 302. Game server 102 preferably generates a random number every fifteen seconds, as determined by counter 302, and transmits that random number to its associated player terminals 100. This centralization of the random number generation provides an efficient and effective means for controlling the games, increases the average number of games played, and helps reduce fraud.

Because of the predetermined interval between generations of random numbers, a player who makes a "play" during that interval, must wait until that interval expires before the player terminal 100 receives the random number and determines a win or loss for that "play." The interval can, of course, be selected to be any predetermined interval to accommodate players and a provider of the system and games.

Figure 4:
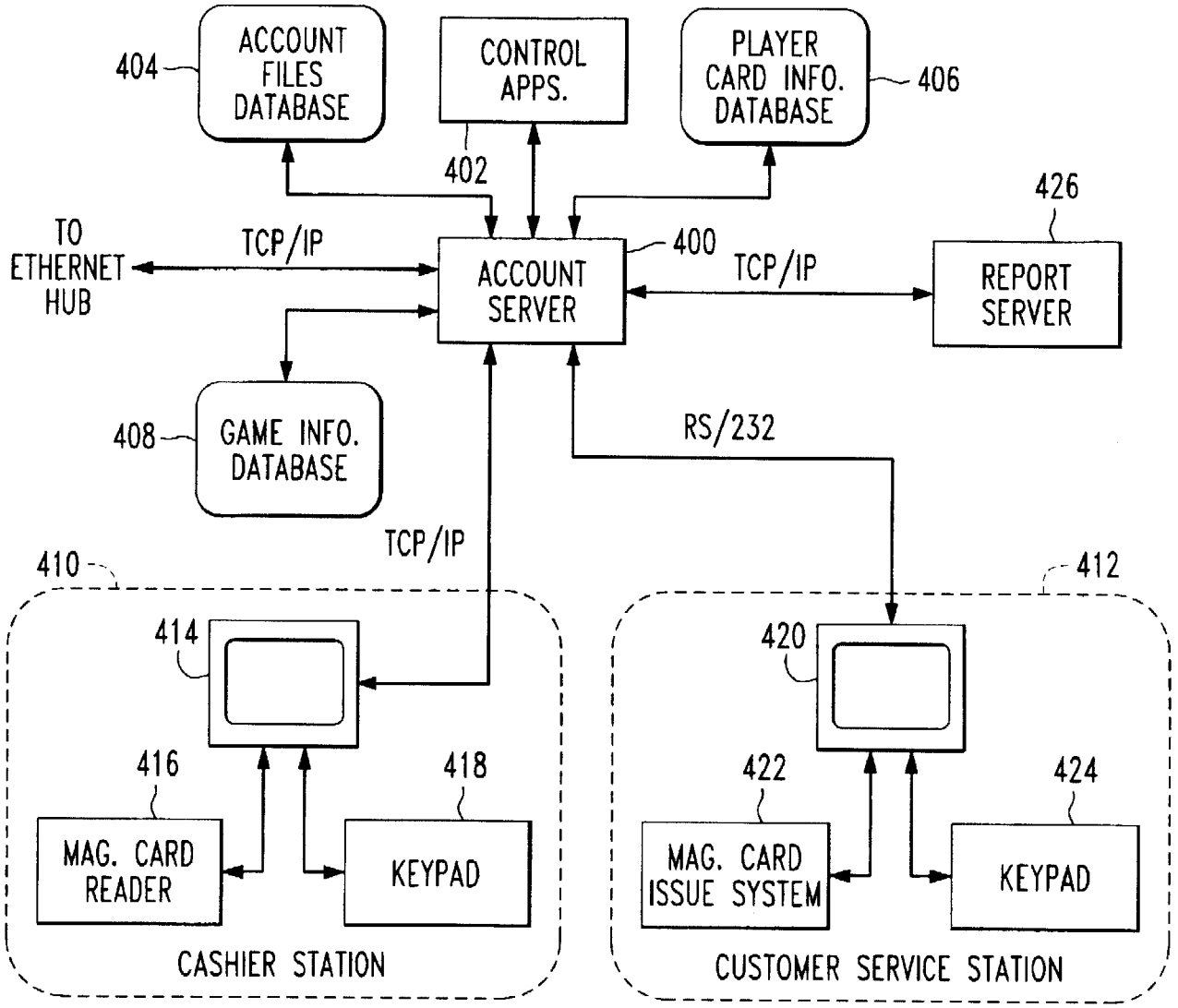
FIG. 4 is a block diagram of a central control network in accordance with one embodiment of the present invention.

In accordance with the present invention, central controller network 104 provides a centralized control means for monitoring and administering all video games and player accounts. FIG. 4 provides a block diagram of the central control network 104 in accordance with a preferred embodiment of the invention.

Central control network 104 preferably comprises an account server 400 running control applications 402 to provide the administrative and service functions described in this application. Account server 400 stores players' account information in an account files database 404, stores player card information in a player card information database 406, and stores game result information in a game information database 408. In addition, account server 400 preferably controls a cashier station 410 and a customer service station 412.

Cashier station 410 preferably comprises an operator terminal 414, connected to the account server via an Ethernet connection, a magnetic card reader 416, and a keypad 418. Customer service station 412 preferably comprises an operator terminal 420, connected to account server 400 via an RS-232 connection, a magnetic card issue system 422, and a keypad 424. Magnetic card reader 416 and issue system 422 preferably comprise conventional devices for reading and generating credit card-type magnetic cards. Likewise, keypads 418 and 424 preferably comprise conventional alphanumeric or numeric keypads, and terminals 414 and 420 preferably comprise conventional PC or networked data entry terminals.

Although the account server 400 is shown as a single element of the central control network 104, in a preferred embodiment, account server 400 comprises a fault tolerant configured paired STRATUS R55 computer.

In addition to administering games and customer accounts, central control network 104 also provides reports on both using a report server 426. Account server 400 preferably trickles information from its databases 404, 406, and 408 to the report server 426, which in turn generates customized or standardized reports in accordance with a service providers' requirements. Report server 426 may comprise, for example, a RS-6000 computer.

At service station 412, a player wishing to use a player terminal 100 can establish an account and receive a magnetic I.D. card to operate the player terminal 100. Preferably, a player provides an operator with some identifying information, and the operator uses terminal 420 to transmit this information to account server 400. Account server 400 establishes an account file for the player in account files database 404 and assigns a corresponding account number to that player. In addition, the operator may ask the customer to select a PIN via keypad 424. The player identifier information, the account number, and an encrypted version of the PIN is then stored on a magnetic strip on a magnetic I.D. card issued by the magnetic card issue system 422. Although not shown, customer service station 412 may also include a scanning device for scanning and storing a player's signature or photograph. Likewise, customer service station 412 may include a camera for photographing the player and including a picture on the player's I.D. card. Account server 400 stores the player's identification information in the player card information database 406. Any scanned information may be stored in a separate file server. Finally, the customer server status 412 may include a printer device to print, for example, customer receipts.

After receiving an I.D. card, the player proceeds to a cashier station 410 to deposit money into his or her account. An operator swipes the card through the magnetic card reader 416 to credit the account via the keypad 418 after receiving payment from the player. Account server 400 stores the player's account information in the account files database 404.

Cashier station 410 also serves to pay players having positive account balances at the end of their play sessions. To receive money, a player provides an operator at cashier station 410 with his/her I.D. card. The operator swipes the I.D. card to retrieve the account balance information verifies the player by requesting the player to input his/her PIN via keypad 418, and pays the player any positive account balance. Although shown as two separate stations, cashier station 410 and customer service station 414 may be combined as a single customer service/cashier station.

To help illustrate the operation of the cashless video game system of the present invention, a preferred method of operation and system process will now be explained with reference to the system elements in block diagrams in FIGS. 1–4 and the process flow diagram shown in FIGS. 5*a* and 5*b*.

Figure 5A:
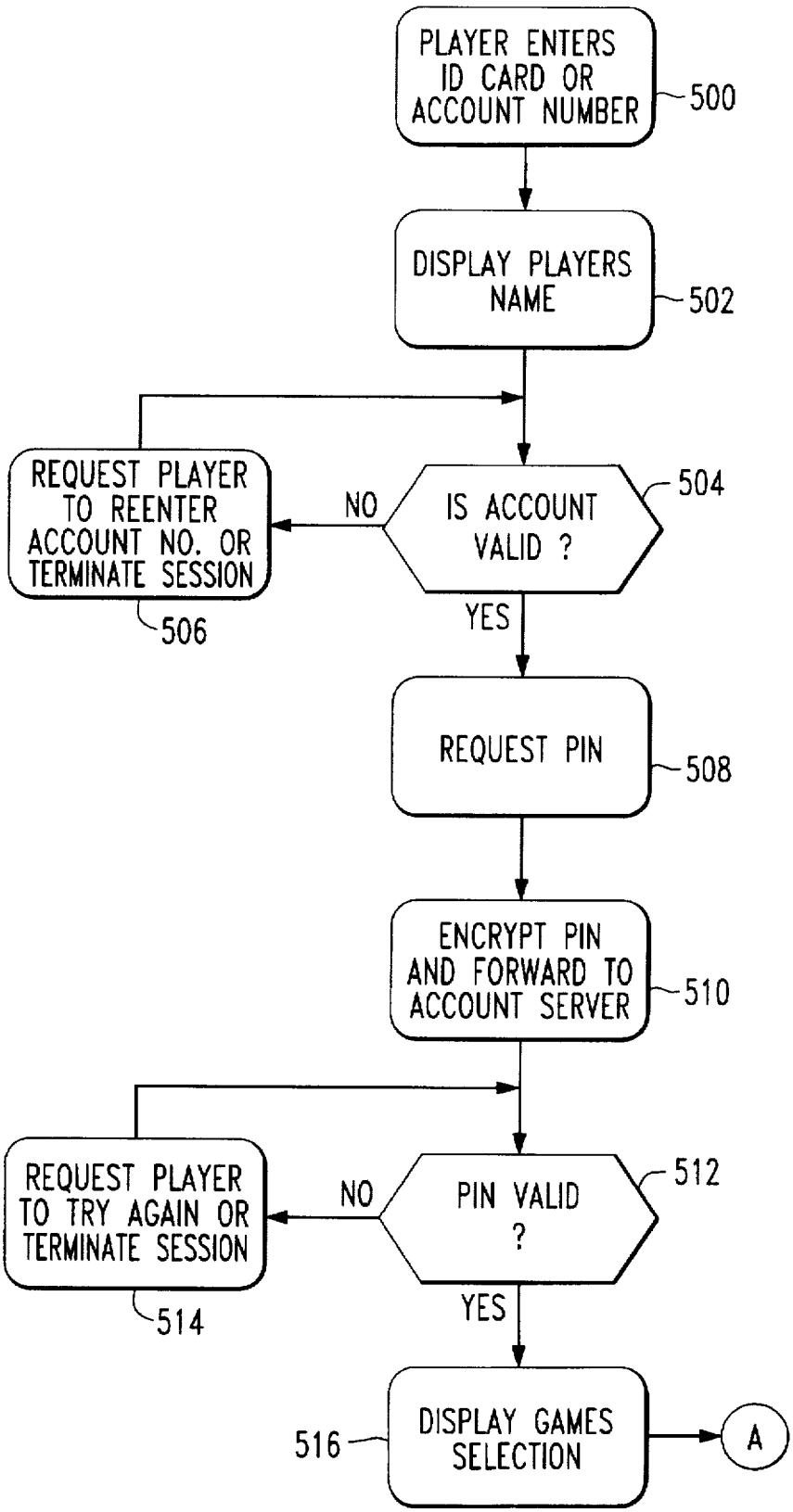
FIGS. 5*a* and 5*b* are process flow diagrams illustrating a method of operating a video game system in accordance with one embodiment of the present invention.
Figure 5B:
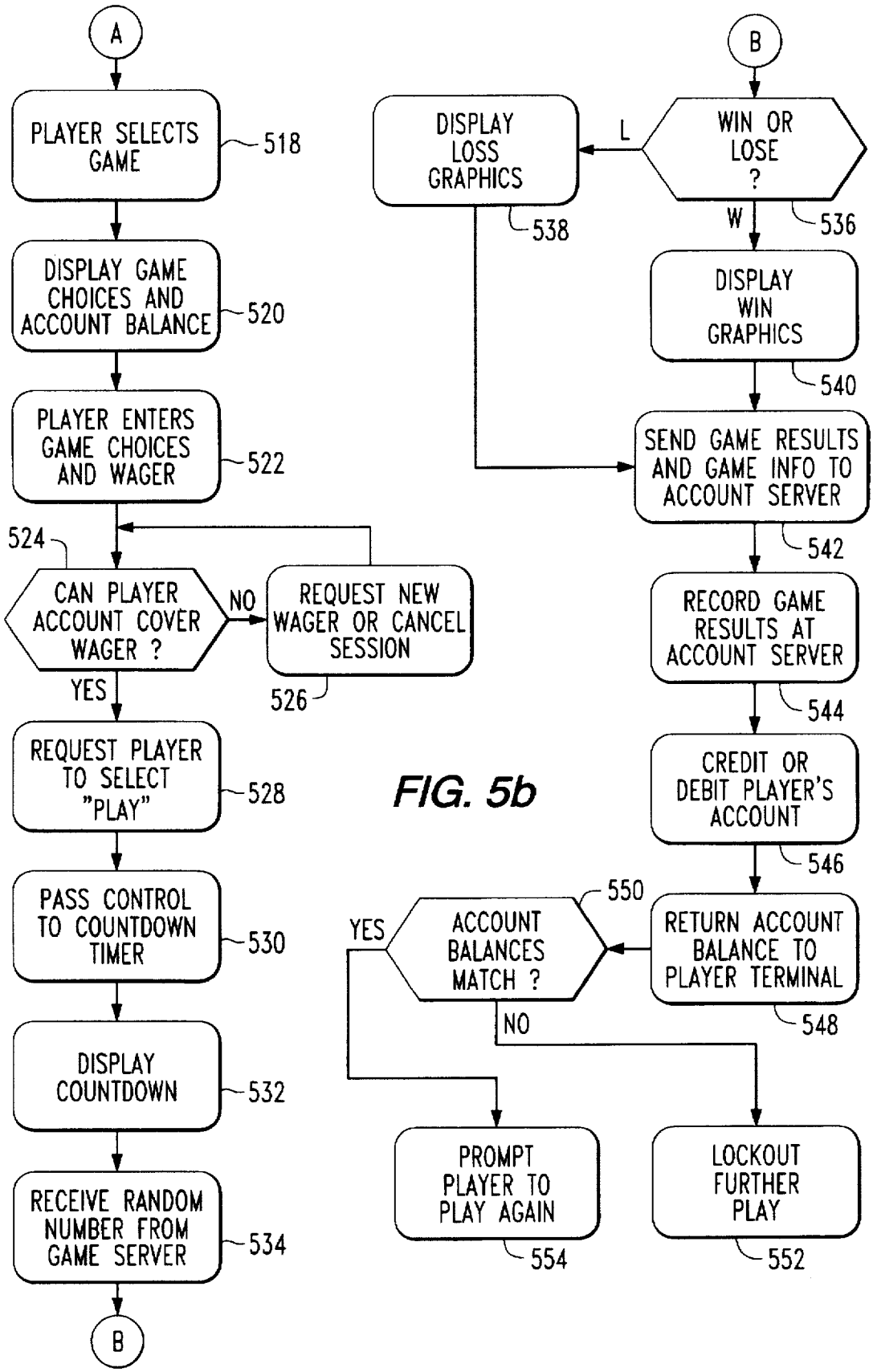

Referring to FIG. 5*a*, after opening a player account and obtaining a player I.D. card, a player logs onto a player terminal 100 by inserting the I.D. card into the magnetic card reader 206 (step 500). Alternatively, the system does not require player I.D. cards, so the player simply enters his/her assigned player account number using keypad 208. The player terminal 100, which has been executing attract mode graphics, reads the information from the I.D. card, displays the player's name (step 502), sends the player account number to the account server 400, and requests the account server 400 to verify the player's account number. Account server 400 receives the account number and, referring to the account file database 404, determines whether the player account number is valid (step 504). If not, player terminal 100 informs the player and either requests the player to reenter the account number or terminates the session (step 506).

If account server 400 determines that the account number is valid, player terminal 100 requests the player to enter his/her PIN (step 508). Player terminal 100 preferably encrypts the PIN and forwards the encrypted PIN to the account server 400 (step 510). Account server 400 receives the PIN and determines whether the PIN is valid and corresponds to the player's account number (step 512). If the PIN is not valid or does not correspond to the player's account number, player terminal 100 either requests the player reenter the PIN, or terminates the session (step 514). If the PIN is valid, player terminal 100 displays a graphical selection of video games on video display 212 (step 516). As described, the video games may include keno, lotto, bingo, etc.

Using the touch screen video display 212 or keypad 208, the player then selects a desired game (step 518). The player terminal 100 displays the corresponding game graphics and requests the player to enter game choices corresponding to that game (step For a particular game, a player may have to make certain selections required by the rules of each game including a selection of predetermined numbers, colors, and/or symbols. For example, if the player selects keno, video display 212 may display eighty numbers from which the player selects up to twenty numbers via the video display screen 212. Player terminal 100 also displays the account balance during a player session.

The player then enters his/her game choices and a wager amount (step 522). In a preferred embodiment, video display 212 also displays the wager amount during each game. Player terminal 100 responds to the waged amount by requesting the account server 400 to verify that the player has a sufficient balance in his/her account to cover the wager.

When the account server 400 receives this request from the player terminal, it makes the requested determination (step 524). If the player has insufficient funds to cover the wager, the player terminal 100 so informs the player and either requests the player to enter a new wager consistent with the player's account balance or terminates the session (step 526). If account server 100 determines that the account balance is sufficient to cover the wager, player terminal 400 informs the player that he/she is authorized to play and requests the player to select a "play" button on the video display 212 or keypad 208 (step 528). Once the player selects the "play" button, player terminal 100 passes control to counter 210 (step 530) and waits to receive a random number from the corresponding game server 102.

Again, as explained above, because game server 102 is generating a random number at a predefined interval, the player who has selected the "play" button during the interval must wait until the player terminal 100 receives the random number to determine the results of the play. Counter 210 in player terminal 100 keeps track of this interval and, in one embodiment, may display the time remaining between the player's selection of the "play" button and the determination of a win or loss (step 532).

At the end of the interval, game server 102 generates a random number and sends it to each corresponding player terminal 100. The player terminal 100 receives the random number from the game server (step 534) and determines whether the player has won or lost that game (step 536). If the player has lost, player terminal 100 displays preselected loss graphics explaining the losing results (step 538). If the player wins, player terminal 100 displays preselected win graphics explaining the winning results (step 540).

Win or lose, player terminal 100 sends a packet of information to the account server 400. This information might include the player's account number, information on the game played and the game choices selected by the player, the waged amount, the winning numbers provided by the game server 102, and a credit or debit request for crediting or debiting the player's account the waged amount (step 542). In accordance with certain requirements, some or all of this information may be encrypted in accordance with conventional encrypting techniques. As described below, player terminal 100 also maintains the player's account balance during a player session.

The account server 400 responds to the data from the player terminal 100 by recording the game information in the game information database 408 (step 544) and crediting or debiting the player's account the waged amount (step 546). Account server 400 then preferably returns the updated account balance to the player terminal 100 (step 548). Player terminal 100 determines whether the returned account balance matches the account balance being tracked by the player terminal 100 (step 550). This additional monitoring of the player's account balance helps protect the game service provider and the player by reducing fraud and detecting balance inconsistencies as early as possible, ideally on a per-game basis. If the account balances do not match, the player terminal 100 may prevent the player from continuing, and request service assistance (step 552). If the account balances match, player terminal 100 preferably prompts the player to choose whether to play again (step 554).

When a player has finished playing, he/she exits the player terminal using an appropriate touch screen command on video display 212 or key on the keypad 208 and returns to the cashier station 410 to settle his/her account. As described, using cashier terminal 414, a cashier (not shown) requests the player account information from the account server 400 and redeems the balance of the player's account to the player.

This description describes the presently preferred embodiments and methods of the present invention, but those skilled in the art would recognize that various changes and modifications may be made, and equivalents may be substituted, without departing from the scope of the invention.

For example, the figures and description include a game server as a separate device for generating random numbers for the player terminals associated with that game server. Each player terminal could also maintain its own random number generator. In this embodiment, the random number generators in each player terminal would preferably be synchronized to provide a random number at a predetermined interval, just as described above for the separated random number generator in a game server. A random number generator could also be provided in the central control network 104 rather than in a separate game server.

In addition, many modifications may be made to adapt a particular element, technique or implementation to the teachings of the present invention without departing from the scope of the invention. Therefore, this invention should not be limited to the particular embodiments and methods disclosed herein, but that the invention include all embodiments falling within the scope of the appended claims.

We claim:

1. A system for operating several games for a plurality of players, comprising:

a plurality of player terminals coupled together, each terminal including means for executing software application programs, in response to a game-independent control input, the application programs corresponding to a plurality of games of chance;

means for receiving player identification information from a participating one of the players;

means for receiving game selection information from the participating player indicating one of the plurality of games; and a video display for displaying a selected one of the games to the participating player;

a game server connected to said plurality of player terminals, and including means for controlling the player terminals' execution of the games by generating the game-independent control input; and a central controller connected to each of said plurality of player terminals, and including means for storing player account information for each of the players; and controlling the execution of the selected game by a game server coupled to the player terminals by generating the game-independent control input;

determining a result of the selected game; and updating the participating player's account file according to the result of each of the games of the selected player terminal.

2. A system as in claim 1, wherein said games are games of chance to which participating players may win or lose, and wherein said means for adjusting includes means for crediting a player's account when a player wins a selected game of chance, and means for debiting a player's account when a player loses a selected game of chance.

3. A method of operating games in a system comprising the steps of:

establishing a player account file at a central controller for a participating player;

receiving, at a selected player terminal coupled to the central controller, player identification information input by the participating player;

displaying, on a video display of the selected player terminal, a plurality of games;

receiving, at said selected player terminal, information for a selected one of the plurality of games;

executing the selected game by said selected player terminal;

controlling the execution of the selected game by a game server coupled to the player terminals;

determining a result of the selected game; and updating the participating player's account file according to data from the selected player terminal.

4. A method according to claim 3, where said games are games of chance to which participating players may win or lose, and wherein the step of updating the player's account includes the steps of crediting the player's account file a predetermined amount when a player wins the selected game of chance; and debiting the player's account file a predetermined amount when a player loses the selected game of chance.

5. A system according to claim 1, wherein said means for controlling includes a random number generator.

6. A method according to claim 3, wherein said controlling step includes the step of generating a random number.

7. A system for operating several games for a plurality of players, comprising:

two or more groups of player terminals, each group of player terminals including a plurality of player terminals coupled together, each terminal including means for executing software application programs, in response to a game-independent control input, the application programs corresponding to a plurality of games of chance;

means for receiving player identification information from a participating one of the players;

means for receiving game selection information from the participating player indicating one of the plurality of games; and a video display for displaying a selected one of the games to the participating player;

two or more game servers, each game server being connected to each player terminal in one of the groups of player terminals, and including means for controlling the player terminals' execution of the games by generating the game-independent control input; and a central controller connected to each of said plurality of player terminals, and including means for storing player account information for each of the players; and means for adjusting the account information of the players according to the results of each of the games from the selected player terminal.

8. A player terminal for a video game system comprising:

means for executing a plurality of video games of chance;

means for receiving player identification information from a participating player;

means for receiving game selection information from the participating player indicating one of the plurality of games;

a video display for displaying a selected one of the games to the participating player;

means for receiving from a game server a game-independent random number; and means for transferring to a central controller game information and a request to debit or credit a player's account.

9. A game server for a video game system comprising:

means for determining a predetermined interval;

means for generating an intermediate, game-independent random number once during each said predetermined interval; and means for sending the generated intermediate random number to each of a plurality of player terminals during each said predetermined interval for use by each of the player terminals in executing one of a selected plurality of games.

10. A central controller for a video game system comprising:

means for connecting the central controller to each of a plurality of player terminals, each player terminal connected to a game server generating a game-independent random number;

means for storing player account information for each player who registers; and means for adjusting the account information of each of the players according to the results of each of the games that the corresponding player participates in at one of the player terminals.

* * * * *

UNITED STATES PATENT AND TRADEMARK OFFICE

CERTIFICATE OF CORRECTION

PATENT NO. : 5,674,128

DATED : October 7, 1997

INVENTOR(S) : Niels C. HOLCH et al.

It is certified that error appears in the above-indentified patent and that said Letters Patent is hereby corrected as shown below:

Claim 1, col. 8, delete lines 56-62 and insert therefor --means for adjusting the account information of the players according to the results of each of the games from the selected player terminal.--.

Claim 3, col. 9, line 11, after "games", insert --of chance--;

line 15, after "executing", insert --software application programs, in response to a game-independent control input, the application program corresponding to--;

line 18, after "terminals", insert --by generating the game-independent control input--; and line 21, "data from" should read --the result of each of the games of--.

Signed and Sealed this

Fourteenth Day of July, 1998

Bruce Lehman

*Attest:*

BRUCE LEHMAN

*Attesting Officer*

*Commissioner of Patents and Trademarks*